US006316531B1

(12) United States Patent
Garware et al.

(10) Patent No.: US 6,316,531 B1
(45) Date of Patent: Nov. 13, 2001

(54) PROCESS FOR DYEING UV STABILIZED POLYESTER FILM

(76) Inventors: Shashikant B Garware; Monika Garware Modi, both of 0-1 and 0-2, Edenhall, 15th Floor, Dr. Annie Besant Road, Worli, Mumbai (IN), 400 018

( * ) Notice: Subject to any disclaimer, the term of this patent is extended or adjusted under 35 U.S.C. 154(b) by 0 days.

(21) Appl. No.: 09/711,911

(22) Filed: Nov. 15, 2000

(51) Int. Cl.[7] ..... C08K 5/34
(52) U.S. Cl. ..... 524/91; 524/96
(58) Field of Search ..... 524/91, 96

(56) References Cited

U.S. PATENT DOCUMENTS 5,981,076 * 11/1999 Ojeda ..... 428/447
6,049,419 * 4/2000 Wheatley et al. ..... 359/359
6,113,811 * 9/2000 Kausch et al. ..... 252/585

* cited by examiner

*Primary Examiner*—Edward J. Cain
(74) *Attorney, Agent, or Firm*—Dennison, Scheiner, Schultz & Wakeman

(57) ABSTRACT

A process for dyeing of UV stabilized polyester film of a thickness about 12 to 250 $\mu$m, and the film produced thereby. The process includes the steps of dyeing a UV stabilized polyester film in a bath comprising at least one dye and at least one polyhydric alcohol at a temperature above a glass transition temperature of the polyester film to obtain a dyed film, cleaning the dyed film using a solvent, followed by mechanically scrubbing the cleaned film to remove undissolved particles from the film, and passing the cleaned and scrubbed film using a tenter device through an oven to produce a colored polyester film having controlled shrinkage in machine and transverse directions, with shrinkage of 0.4% to 8% in machine direction and 0 to 10% in transverse direction.

22 Claims, 3 Drawing Sheets

PROCESS FOR DYEING UV STABILIZED POLYESTER FILM

BACKGROUND OF THE INVENTION

The invention relates to the field of dyeing of polyester films.

The energy crisis of the 1970's resulted in the development of many processes and products for energy conservation and many countries accorded priority to such efforts in parity with environmental protection. One of the means of saving energy successfully attempted by scientists has been through laminated films. U.S. Pat. Nos. 3,943,105, 4,047,889 and 4,115,054 of Julius Hermes and U.S. Pat. No. 4,399,265 of Garware et al were all directed towards this subject matter. More specifically, the Garware et al patent was directed to a new process for the manufacture of dyed film for sun control applications.

Dyed polyester films have numerous applications including solar controls films for window application, light filters in research laboratories and industrial applications, colored films for decorative applications, packaging applications and greenhouse applications.

U.S. Pat. No. 4,399,265 discloses a process for producing UV stabilized polyester films in which UV absorbers from the benzophenone and benzotriazole group are blended with polyester granules in the desired concentration, and extruded or co-extruded to obtain a UV stabilized film in various thicknesses.

U.S. Pat. No. 3,943,105 discloses a process for UV stabilization of dyed or undyed film by a solvent assisted treatment. The films are treated with UV stabilizer and carriers such as polyhydric glycols at 250 and 430° F. Subsequently, the treated film is washed with water to remove excess surface solvents.

In the case of colored polyethylene terephthalate (PET) films used for solar control applications/greenhouse applications, the films are exposed to electromagnetic radiation from the sun. A high energy UV component having a wave length ranging from 200 nm to 400 nm is responsible for decomposition of organic matter, and the films must therefore be UV stabilized to prevent the destructive effects of UV radiation. Another important function of UV stabilization is to prevent UV radiation from passing through the windows.

The PET window films are generally available in laminate form, which consist of a UV stabilized colored film coated with pressure sensitive adhesive which is protected with a release liner. One of the known methods of dyeing the film is to incorporate mixtures of blue, red and yellow dyes in the polyester matrix before extrusion. The concentration of dyes to be incorporated in the polymer matrix depends upon the required shade and transmission. The dyes are mixed in the polymer matrix during polymerization, and the polymer matrix is directly fed to the extruder followed by biaxial orientation.

These films have exceptional dimensional stability against thermal aging and outdoor exposure. It is not, however, practical to produce small quantities of colored films using this method, as colors cannot be changed in the production runs.

U.S. Pat. No. 4,047,889 describes a method of waterless dyeing or solvent-assisted dyeing, which involves swelling of polyester films with high boiling polyhydric alcohols and glycols. The swelling of the polyester matrix at high temperatures is followed by a dye treatment. The dyes in contact with the polymer matrix diffuses into the film; the rate of dye diffusion depends upon the concentration of individual dyes in the bath and swelling capability of the solvent.

These films are subsequently washed with low boiling solvents such as methanol, ethanol and chlorinated low boiling solvents, which are continuously recycled in the process. This method does not generate effluent but there is very high risk of explosion and a fire hazard.

U.S. Pat. No. 4,115,054 is a continuation-in-part of the above patent, which includes the non aqueous dyeing of woven polyamide, woven polyester fibers and polyamide knitted fabrics.

SUMMARY OF THE INVENTION

It is an object of the invention to provide an improved method for dyeing of polyester films, with a reduced risk of fire and explosion.

It is a further object of the invention to provide dyed polyester films with reduced shrinkage in the machine direction and/or the transverse direction.

To achieve these and other objects, the invention is directed to dyeing of UV stabilized polyester films using disperse dyes and polyhydric alcohols at a temperature above the glass transition temperature of the film. The process dyeing of pre-UV stabilized polyester film with disperse dyes dissolved or suspended in polyhydric alcohols and polyhydric glycols, and requires polyhydric glycols/alcohols as a carrier medium when the additives are added in the solvent medium, followed by pinching, washing with high boiling solvents or water, scrubbing and finally drying the film in an oven at higher temperatures using the tenter process. The shrinkage properties are monitored in MD and TD directions.

This invention also provides a safe, explosion proof process. In the prior art, low boiling solvents were used for cleaning, which made the process hazardous. The washing step in the process of the invention includes cleaning of the films with high boiling solvents followed by a mechanical scrubbing operation, and removes undissolved particles on the films which include degraded dyes, polyester oligomers and excess undissolved colors.

This invention further provides a dyed polyester film having controlled shrinkage in MD and TD directions. The films have shrinkage values not more than 10% either in the machine direction or the transverse direction or in both directions after 30 minutes treatment in an air circulated oven at 150° C. The controlled shrinkage films of the invention have excellent shrinkage properties and are suitable for installation on curved window glasses of automobiles. A specially designed tenter is used for obtaining the controlled shrinkage property of the polymeric films.

The invention thus provides window film laminates for installation on the curved glasses of automobiles using a hot air gun at the time of the film installation.

The invention utilizes polyester films produced by extrusion, where the UV stabilizers are incorporated in the polymer matrix before the extrusion process.

DESCRIPTION OF THE PREFERRED EMBODIMENTS

Figure 1:
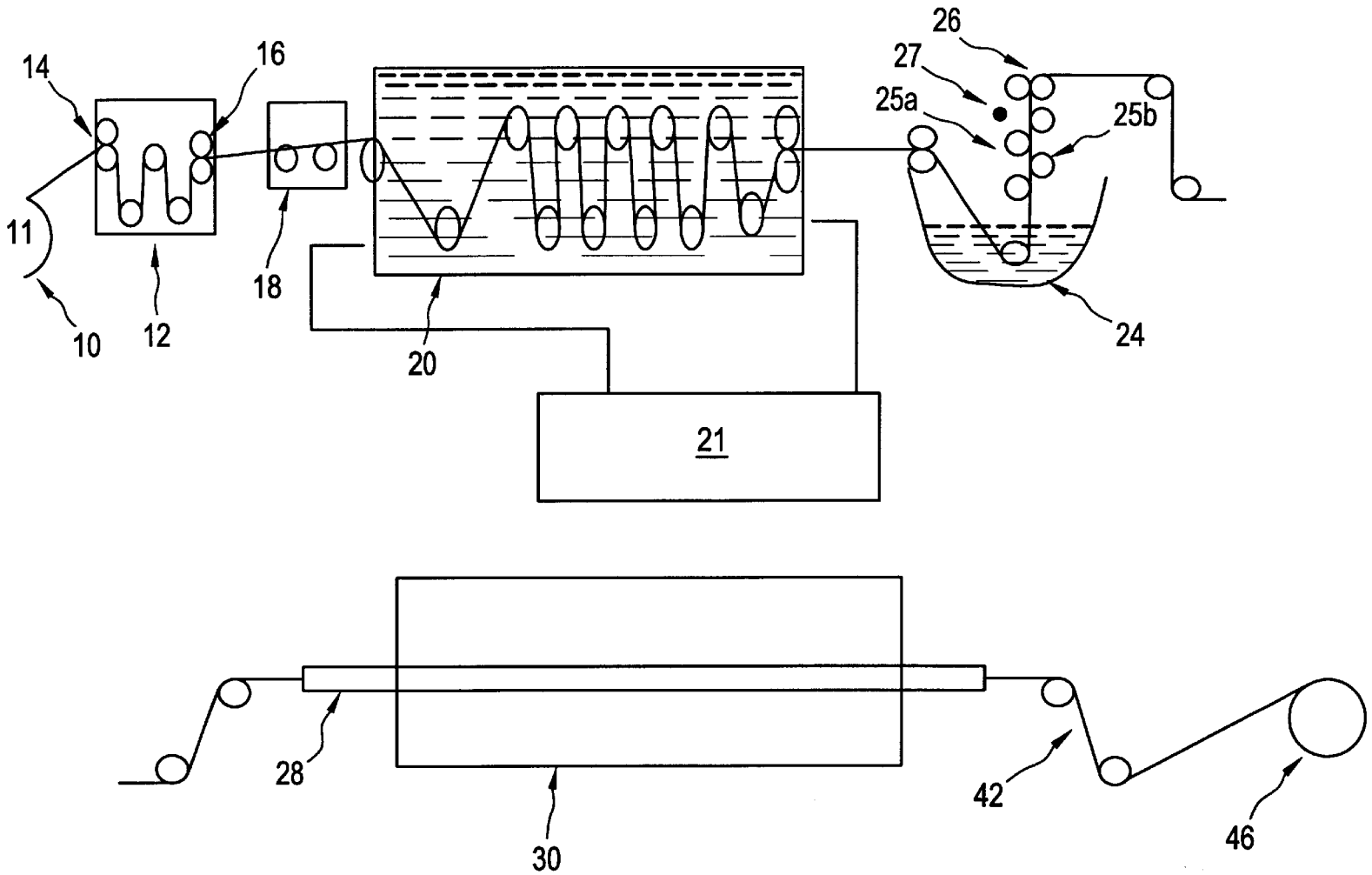
FIG. 1 is a schematic diagram showing the process steps of the invention.

Polyester films of the invention are composed of polymers having ester groups produced by polymerization of dicarboxylic acids and diols, or by ester exchange polymerization of dimethyl terepthalate and monoethylene glycol. Dicarboxylic acids includes terepthalic acid, isopthalic acid, 2,6-napthalene dicarboxylic acid and 1,4-cyclohexane dicarboxylic acid. The diols includes monoethylene glycol, diethylene glycol, triethylene glycol and polyethylene glycol. Typical polyesters include polyethylene teraphthalate, polyethylene 2,6-naphthalate, and co-polyesters of 1,4-cyclohexane dicarboxylic acid.

The thickness of the polyester films used in the invention is generally in the range of 12 to 250 $\mu$m, preferably between 12 and 175 $\mu$m.

The film used in the present invention is "pre-UV stabilized". The UV absorber is thus incorporated in the polymer matrix at the polymerization stage or before extrusion, followed by extrusion and biaxial orientation. Specified proportions of 2,6-naphthalene dicarboxylic acid and UV absorber are incorporated in the polymer matrix. The one or more UV absorbers which may be added include benzophenones, benzotriazoles and benzoxazinones, and are incorporated in the specified proportions before extrusion. The type and concentration of UV absorber depend on the requirements of the product; combinations of two or three absorbers are preferable to obtain a synergistic effect. The UV transmittance of the film of the invention is below 2%.

The base substrate film used in the present invention is a biaxially oriented film having good dimensional stability. The film has a shrinkage value of less than 10% in the longitudinal direction and in the machine direction. The shrinkage and tensile strength values should be the same across the web width and throughout the length. Any deterioration of orientation properties affects the quality of dyeing.

The shrinkage properties are adjusted by stretching the film in the dyeing apparatus and in the tenter chain for achieving the desired shrinkage values in MD and TD direction. MD shrinkage value is a function of base film shrinkage and machine direction stretching above the glass transition temperatures in the dye bath. MD stretching is done by monitoring the differential speeds of nip rollers at the entrance of the dye bath, and squeezing the nip rollers of the dyeing apparatus.

Electromagnetic radiation from sun includes near IR, visible and ultraviolet radiations components. The UV component of solar elctromagnetic radiation is primarily responsible for decomposition of organic matter, colored fabrics and interior decorations. It is therefore necessary to minimize or stop the UV radiation passing through window panels.

Manufacturing of the polyester films according to the invention includes the following steps:

1. Coloring Process

Disperse dyes are selected from a wide range of dyes with good light fastness and thermal stability in solvents at higher temperatures. Many dyes having these characteristics are available commercially. The dye mixture is dissolved or suspended in solvents in the desired concentration, which is in the range of 0.05% to 5% on dry weight basis. The dye mixture is usually a mixture of dyes, including blue, red and yellow. The concentration of individual colors is suitably selected in order to obtain the desired color and visible light transmittance or color depth. A wide range of the shades can be obtained by changing the concentration of individual colors. A single dye may be used; in many cases, a combination of two to five dyes will be used in the bath. It is a continuous process.

Light filters can be produced by using the above mentioned set of dyes, which can have complete control over electromagnetic radiation in the visible range.

The film passes through the dye bath at a speed of 10 to 80 meters/min, preferably between 40 and 80 meters/min.

The selected solvents should have a sufficient swelling capability within the polymer matrix. The rate of diffusion of colors depends upon the type of the disperse dye selected from a wide range of dyes.

2. Solvent Cleaning

After attaining the desired level of UV stabilization and color depth, the film is quenched in chilled water and then passed through solvents. The temperature of the chilled water is maintained between about −5° and 10° C. The film surface has a thin layer of solvent along with undissolved free dust, UV stabilizer and polyester oligomers. When the film is suddenly quenched in the chilled water, the dissolved additives are precipitated onto the film surface. This precipitated free dust can be removed easily by a high velocity solvent spray. Ultrasonic energy may also be applied to remove particles from the film, and is one of the effective methods of cleaning. This method is especially used for the manufacture of dark shade films. Because low boiling solvents of the prior art are not used, there is no risk of explosion or fire.

The solvents selected for cleaning the colored film belong to the high boiling group having a boiling point above 110° C. These solvents have a high salvation power and high flash point. Solvents used for cleaning include dimethyl formamide, santosol, benzoyl alcohol, 2-vinyl-pyrrolidone, dimethyl sulfoxide and dimethyl acetamide.

The process is continuous, and the residence time of the film in the tank is between 60 to 180 seconds. Since the film is continuously passing through the solvents, some quantity of unwanted surface contamination affects the purity of the solvent in the tank and therefore it is necessary to remove at intervals some quantity of used solvents from the tank for purification by distillation, and to simultaneously add an equivalent quantity of pure solvents. The solvent distillation is carried out under high vacuum and at relatively low temperatures, and the distilled fraction of used solvent is recycled for washing. The residual dye along with solvent in the distillation vessel can be recycled.

The process of the invention is safe, as the temperature of the solvent is always maintained below the flash point of the solvent. To ensure safety, high velocity exhaust blowers may be mounted near the solvent tank with air replacement rate 1500 $m^3$/hr.

3. Scrubbing

Solvent cleaning is followed by scrubbing and rinsing with water. A set of eight rollers is mounted on the scrubbing (tank, in which four rollers are mounted on top side of the film and four rollers are mounted on the opposite side of the film. Each roller or bar is wound with cloth and lapping movement is also provided to minimize pressure of the scrubbing material on the film, depending on the type and thickness of the film to be cleaned. Care must be taken not to damage the film surface, as even a slight increase in the pressure of the bars on the film may lead to a scratching problem. Water mixed with surfactants is continuously spread on the cleaning cloth. The scrubber assembly is provided with a self cleaning device in which a high pressure jet is provided before squeezing the film between nip rollers.

Water in the process is continuously recycled and filtered through 0.3 micron cartridge filters. The scrubbing process may be computer controlled, and set to operate in automatic mode or in manual mode. The speed of the film and pressure of the pneumatic cylinders control the cleaning capability of the cloth wound rollers. The oscillations along with rotation can be adjusted according to the requirement of the surface characteristics of the film, thickness of the film and product type. Enzyme based surfactants can be used for washing the film.

4. Tenter Process

The colored polyester film is passed through a specially designed tenter chain. The tenter chain includes carbon steel links fitted with hardened, grooved rollers and bushes or bearings. The chain is provided with continuous lubrication and is equipped with autofeed devices. High velocity air is circulated in the drying chamber from the top and bottom sides of the chamber; uniform air distribution is made in the oven.

The tenter having two parallel chain tracks is provided with digital width indications mounted across the length of the chain to monitor width at various locations. The tenter chain plays a major role in monitoring the shrinkage property of the polyester film. The desired shrinkage values can be monitored by adjusting the width of the web from the entrance and exit ends of the tenter.

The cleaned film passes through the tenter where the specially designed clips holds the film tightly in the lower and upper jaws. The jaws are provided with a soft rubber lining, which helps in holding the film tightly in the jaws. The tight film is fed into the oven at temperatures maintained between 130° and 250° C. at a speed of 40 to 80 meters/min.

The film is allowed to shrink in the oven or can be stretched in the oven in the transverse or machine direction. The film produced in the tenter process has excellent shrinkage properties. The shrinkage values in MD and TD directions are controlled consistently lot to lot and roll to roll.

The tenter is provided with two parallel tracks along with chain clips mounted on the links. The variable drives mounted at four locations can change the distance between two parallel tracks and are equipped with a digital width recorder. The films are allowed to shrink in the first zone of the oven followed by stretching and relaxation in the next two zones.

In the first zone, the film is allowed to shrink between 0 and 150 mm across the transverse direction, preferably between 2 mm and 20 mm. The films are stretched in the second and third zones between 0 and 300 mm. The stretching ratio is varied depending on the thickness of the film to be processed. The fourth zone is a relaxation and stabilization zone. The parameters are decided by considering the basic properties of the colored film and film thickness.

The films stretched in the second and third zones are allowed to stabilize and relax in the fourth zone. This dimensionally stabilized film is then allowed to cool with cold air jets. The colored film is finally wound on a paper or metal core of a winder. The final product obtained from this process receives an accelerated weathering test and tests for sun control capability, light fastness and thermal properties. The UV transmittance of the colored film is monitored at below 2%.

The films are tested for thermal stability in an oven at 150° C. for 30 minutes in accordance with ASTM D1204-94. The films have good thermal aging properties tested at 70° C. for 1000 hrs.

The light fastness of the dye and UV treated polyester films is tested using the accelerated weathering tester of Q-Panel Co. and Xenon Arc Weatherometer manufactured by Atlas Company. The test method involves exposing the films to alternate cycles of light and dark.

The polyester sheets with dyes and UV absorber can withstand exposures of more than 2000 hours in the QUV tester using UV fluorescent lamps of A Type with energy maximum at 351 nm.

The colored polyester film produced by this invention has visible light transmittance as low as 2% and as high as 82%. The films can be produced in various shades. The concentration of various dyes in the dye bath and the temperature decides the final color and transmission of the substrate. The speed of the process and concentration of dyes in the dye bath determines the visible light transmission properties.

EXAMPLE 1

UV stabilized polyester films with thicknesses 12, 23, 36, 50 and 100 $\mu$m produced by Garware Polyester Ltd. are used for obtaining colored polyester films according to the invention. The process steps of the invention are illustrated in FIG. 1.

The roll of film 10 on unwinder 11 has been previously UV stabilized during extrusion of the film. A combination of benzophenone, benzotriazole and benzoxazinone are incorporated into the polymer matrix in specific proportions to obtain a synergistic effect. The dye and carrier mixture is heated to 160° C. The polyester film passes through the dye bath at a speed of 60 meters/min followed by squeezing between nip rollers 14 and 16 of dying apparatus 12 and quenching in water.

The shrinkage properties are adjusted by stretching the film in the first tank and in the tenter chain for achieving the desired shrinkage values in the MD and TD directions. MD stretching is done by monitoring differential speeds of nip rollers 14 at entrance drive 1 and squeezing nip rollers 16 at exit Drive II of the dyeing apparatus.

The dye-treated film passes through cleaning apparatus 20, in which high velocity solvent is sprayed on the film surface to remove excess chemicals and free dust adhered on the film. Further cleaning takes place in water tank 24, and solvents from the cleaning apparatus 20 may be purified in distillation unit 21. Subsequently, the film passes through a mechanical scrubber 24, including a set of 8 rollers mounted on the scrubbing tank, in which four rollers 25*a* are mounted on the top side of the film and four rollers 25*b* are mounted on the opposite side of the film. Each roller or bar is provided with a pneumatic cylinder (shown schematically as 26) to increase or decrease the abrasion pressure on the film.

The water in scrubber 24 is mixed with surfactants and continuously spread on the scrubbing rolls. The mechanical scrubber is a self-cleaning device provided with a high pressure jet 27 before squeezing the film in the nip rollers. Water is continuously recycled and filtered through 0.3 $\mu$m cartridge filters. Enzyme based surfactants may be added in the water up to 0.5% by weight.

Figure 2:
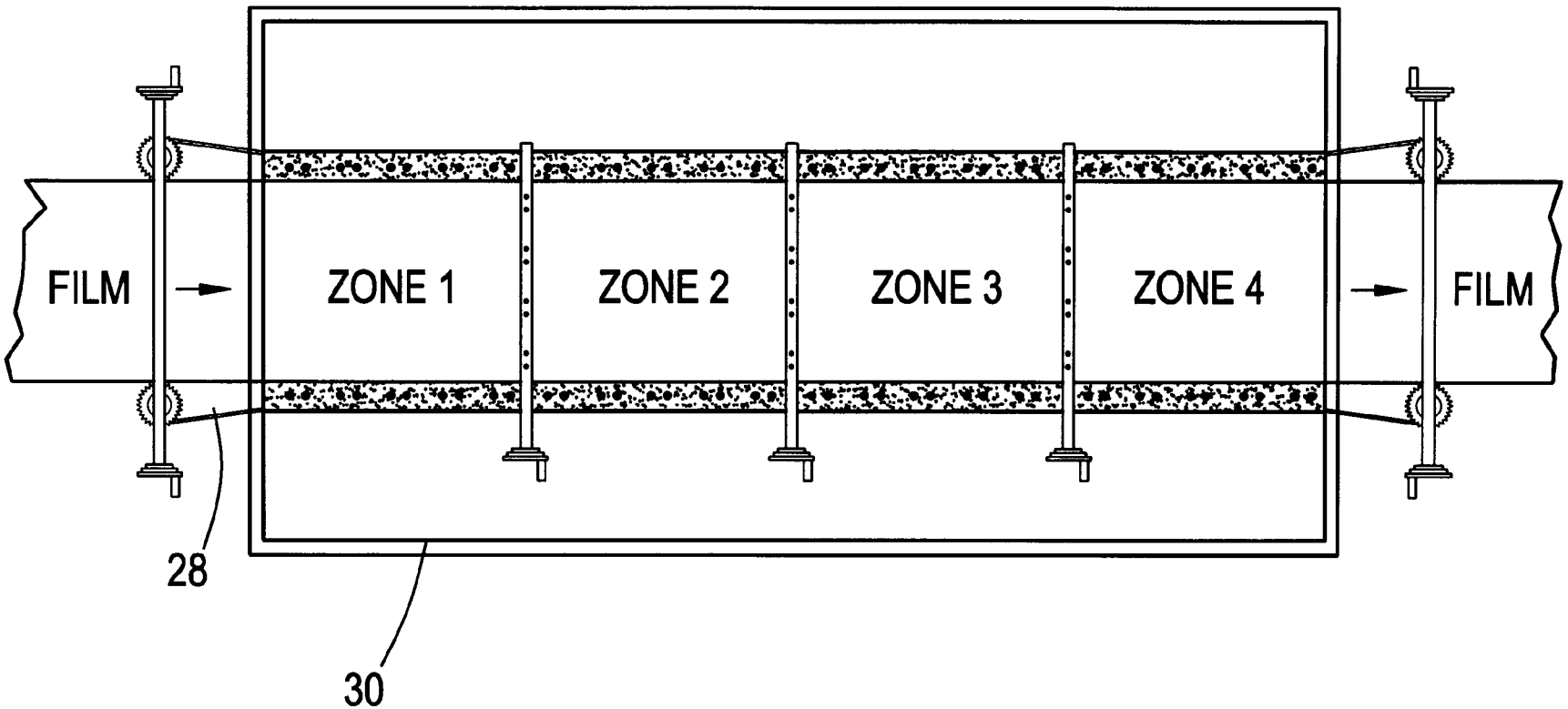
FIG. 2 is a cross sectional view of an oven for treating film according to the invention.

The dyed treated and cleaned film passes through tenter 28, shown in more detail in FIG. 2. The tenter has two parallel chain tracks with 5 width indicators equipped with variable drives mounted across the length of tenter 28. The tenter chain includes carbon steel links fitted with hardened grooved rollers, brushes or bearings. The tenter chain is equipped with an oven having four separate zones, each zone being provided with hot air nozzles, and showers mounted on the top and bottom sides of the film. Temperature and air flow are individually monitored.

Figure 3:
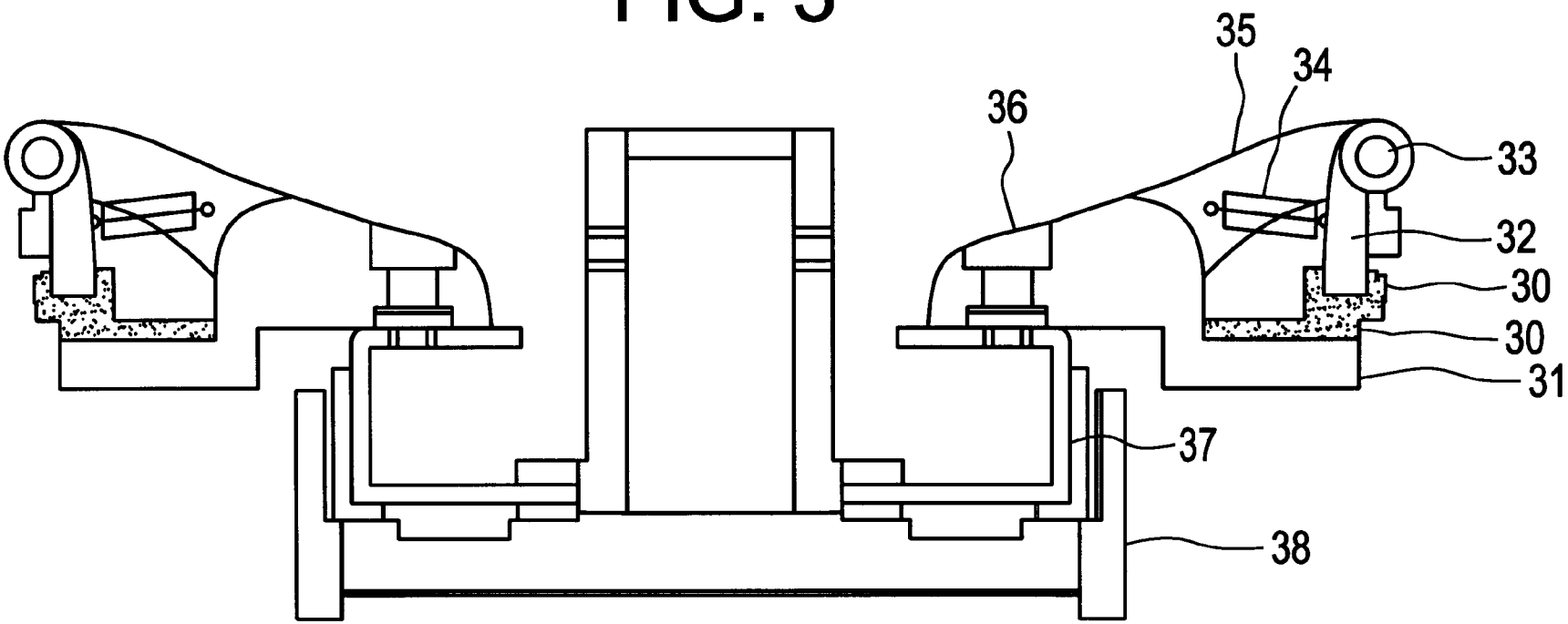
FIG. 3 is a cross sectional view of a tenter chain.

In operation, tenter chain 37 is continuously rotated on track 38. The specially designed clips, shown in more detail in FIG. 3, hold the film tightly in lower jaw 31 and upper jaw 32. A spring 34 is provided to increase or decrease the force required to hold the film tightly in the jaws. The body of chain 35 is mounted on the chain through a body bolt 36.

The lower and upper jaws are provided with a soft rubber lining 30 to prevent the film from tearing while being processed.

The film is fed through the oven at temperatures ranging from 150° to 235° C. in four zones.

The film is allowed to shrink 8 mm in the first zone in the transverse direction followed by stabilization in the fourth zone. The stabilized film is allowed to cool by using high velocity cold air jets 42. Further, the film may be passed through a web cleaner, not shown, and the film is finally wound on a metal core at rewinder 46. Thereafter the roll produced in the above process is slit to the desired length and width.

The film obtained in this process has a uniform color and transmittance through out the length and width of the roll. The transmission variation across the web width is 2% and UV transmittance below 2%. Trial results are shown in Table 1, below.

TABLE 1

| Film Thickness μm | Optical Density at 355 nm Before Dying | Oven Temperatures ° C. Zone 1 | Zone II | Zone III | Zone IV | Film Shrinkage MD | TD | Optical Density at 355 nm After Dying | Visible Light Transmittance After Dying |
|---|---|---|---|---|---|---|---|---|---|
| 12 | 2.15 | 150 | 180 | 190 | 200 | 2.00 | 0.80 | 1.9 | 21.5 |
| 23 | 2.05 | 150 | 180 | 195 | 205 | 2.40 | 0.60 | 2.2 | 19.5 |
| 36 | 2.01 | 150 | 180 | 205 | 210 | 2.40 | 0.07 | 2.3 | 20.3 |
| 50 | 1.90 | 150 | 180 | 210 | 215 | 2.00 | 0.04 | 2.2 | 35.2 |
| 100 | 2.10 | 150 | 185 | 220 | 230 | 2.80 | 0.08 | 2.5 | 35.5 |

PET Film width between 48" and 76"
MD = Machine Direction
TD = Transverse Direction

EXAMPLE 2

Polyester films of 12, 23 and 36 μm in thickness are used for obtaining colored polyester films. The process is generally the same as described in Example 1, and shown in FIG. 1, except for changes in tenter and oven settings. Temperature of the oven in this example is set at 150 to 200° C. The results are set forth in Table 2 below, with the film stretched in TD direction at various stretch ratios as given in the table.

TABLE 2

| Sample No. | Stretching Ratio | Thickness 12μ MD % | TD % | Thickness 23μ MD % | TD % | Thickness 36μ MD % | TD % |
|---|---|---|---|---|---|---|---|
| 1 | 0.997 | 1.6 | −1 | 2.0 | −0.8 | 2.4 | 0 |
| 2 | 1.009 | 1.2 | 0.6 | 1.8 | 1.0 | 1.2 | 1.4 |

TABLE 2-continued

| Sample No. | Stretching Ratio | Thickness 12μ MD % | TD % | Thickness 23μ MD % | TD % | Thickness 36μ MD % | TD % |
|---|---|---|---|---|---|---|---|
| 3 | 1.018 | 1.1 | 1.2 | 1.6 | 1.6 | 2 | 2 |
| 4 | 1.036 | * | * | * | * | 1.6 | * |

*Fi1m breaks
Oven Temperature 150–200° C.
Fi1m width 48" to 76"
Differential speed between Drive No. 1 and Drive No. 2 is 0.5%.

EXAMPLE 3

All process conditions are the same as in Example 2 except for oven temperature which is increased to 170 to 220° C. The results are set forth in Table 3 below.

TABLE 3

| Sample No. | Stretching Ratio | Thickness 12μ MD % | TD % | Thickness 23μ MD % | TD % | Thickness 36μ MD % | TD % |
|---|---|---|---|---|---|---|---|
| 1 | 1.009 | 1.8 | −0.8 | 2.0 | 1.2 | 2.6 | 0.8 |

TABLE 3-continued

| Sample No. | Stretching Ratio | Thickness 12μ MD % | TD % | Thickness 23μ MD % | TD % | Thickness 36μ MD % | TD % |
|---|---|---|---|---|---|---|---|
| 2 | 1.018 | 2 | 1.0 | 2.0 | 2.0 | 2.8 | 3.2 |
| 3 | 1.036 | 1.8 | 2.2 | 1.8 | 2.4 | 3.2 | 4.2 |
| 4 | 1.053 | 2 | 2.4 | 1.6 | 3.0 | 3.6 | 4.8 |
| 5 | 1.074 | * | * | * | * | 3.6 | 5.2 |

*Film breaks
Oven Temperature 170–220° C.
Film width 48" to 76"
Differential speed between Drive No. 1 and Drive No. 2 is 1%.

EXAMPLE 4

All process conditions are the same as in Example 2, except oven temperature, which is 180 to 235° C. The results are set forth in Table 4 below.

TABLE 4

| Sample No. | Stretching Ratio | Thickness 12μ MD % | Thickness 12μ TD % | Thickness 23μ MD % | Thickness 23μ TD % | Thickness 36μ MD % | Thickness 36μ TD % |
|---|---|---|---|---|---|---|---|
| 1 | 1.009 | 1.6 | 0.4 | 2 | 1 | 2.8 | 1.4 |
| 2 | 1.018 | 1.8 | 1.6 | 2.4 | 2.4 | 3.0 | 2.8 |
| 3 | 1.036 | 1.8 | 2.6 | 2.2 | 3.2 | 3.6 | 4.6 |
| 4 | 1.053 | 2 | 2.6 | 2.6 | 4.6 | 3.6 | 5.0 |
| 5 | 1.074 | * | * | 2.6 | 7 | 4.0 | 5.5 |

Oven Temperature 180–235° C.
Film width 48" to 76"
Differential Speed between Drive No. 1 and Drive No. 2 is 1.5%.

EXAMPLE 5

All process conditions are the same as in Example 4, except for the base film used. The base film used for this trial has higher shrinkage in MD and the film is stretched in MD in the dye bath. The results are set forth in Table 5 below.

TABLE 5

| Sample No. | Stretching Ratio | Thickness 12μ MD % | Thickness 12μ TD % | Thickness 23μ MD % | Thickness 23μ TD % | Thickness 36μ MD % | Thickness 36μ TD % |
|---|---|---|---|---|---|---|---|
| 1 | 1.009 | 2.4 | 1.6 | 3.6 | 1 | 3.6 | 2.4 |
| 2 | 1.018 | 2.6 | 2.6 | 3 | 2.4 | 4.0 | 3.6 |
| 3 | 1.036 | 2.6 | 3.2 | 3.4 | 4.2 | 4.8 | 4.8 |
| 4 | 1.053 | 2.8 | 4.0 | 4 | 5.2 | 5 | 6.5 |
| 5 | 1.074 | * | * | 4.2 | 7.4 | 5.8 | 10.2 |

Oven Temperature 180–235° C.
Film width 48" to 76"
Differential speed between Drive No. 1 and Drive No. 2 is 5%.

The desired MD shrinkage is obtained by varying MD stretching in the dye bath and respective shrinkage of the base From the foregoing, it is evident that the invention rectifies many of the shortcomings and limitations of prior art. In particular, the invention makes possible a hazard free and explosion free process, meeting with global safety standards and objectives. The resultant end product is far superior to similar products available in the market, in terms of uniformity of color, control of shrinkage and light transmission levels. A significant factor is that the specialized process makes a product suitable for installation on the curved window glass of automobiles, which has not previously been possible.

What is claimed is:

1. A process for dyeing of UV stabilized polyester film of a thickness about 12 to 250 μm, with controlled shrinkage properties, comprising the steps of:

dyeing a UV stabilized polyester film in a bath comprising at least one dye and at least one polyhydric alcohol at a temperature above a glass transition temperature of the polyester film to obtain a dyed film;

cleaning the dyed film in a solvent, followed by mechanically scrubbing the cleaned film to remove undissolved particles from the film; and passing the cleaned and scrubbed film held by tenter means through an oven to produce a colored polyester film having controlled shrinkage in machine and transverse directions, with shrinkage of 0.4% to 8% in machine direction and 0 to 10% in transverse direction.

2. The process according to claim 1, wherein the polyester film which is to be dyed is clear and has UV transmittance below 2%.

3. The process according to claim 1, wherein the polyester film which is to be dyed is clear and has shrinkage in machine direction of 1 to 10% and in transverse direction of 0 to 5%.

4. The process according to claim 1 wherein the polyester film which is to be dyed is clear, is produced by extrusion, and includes at least one UV absorber selected from the group consisting of benzophenones, benzotriazoles and benzoxazinones.

5. The process according to claim 1, wherein the cleaning solvent is a high boiling solvent.

6. The process according to claim 5, wherein the high boiling solvent is selected from the group consisting of dimethyl formamide, santosol, 2-vinyl pyrollidone, dimethyl sulfoxide, dimethylacetamide and mixtures thereof.

7. The process according to claim 1, wherein the mechanical scrubbing is performed with a soft cloth material wound on rollers.

8. The process according to claim 7, wherein the rollers are caused to oscillate and to rotate in clockwise and counter-clockwise directions.

9. The process according to claim 7, wherein the rollers are provided with pneumatic cylinders to adjust lapping at a point of contact of the cloth and the film.

10. The process according to claim 7, wherein the mechanical scrubbing further comprises jetting of cleaning fluid at high speed to remove dirt trapped in the cloth material.

11. The process according to claim 7, wherein the cleaning fluid comprises water containing a surfactant.

12. The process according to claim 1, wherein the tenter chain includes of chain clips having jaws with a soft rubber lining mounted on thereon.

13. The process according to claim 12, wherein the rubber lining comprises silicone rubber.

14. The process according to claim 12, wherein the tenter has adjustable tracks and a chain provided with a width indicator mounted at a plurality of locations on the tenter to monitor film stretching and film relaxation at said locations.

15. The process according to claim 12, wherein the oven is maintained at a temperature of 150 to 240° C.

16. The process according to claim 1, wherein the polyhydric alcohol is at least one of mono-ethylene glycol and propylene glycol.

17. The process according to claim 1, wherein the bath contains from one to of five disperse dyes.

18. A colored polyester film having a shrinkage in machine direction of 0.4% to 10% and in transverse direction of 0.2% to 10%, and produced by a process comprising the steps of:

dyeing a UV stabilized polyethylene film in a bath comprising at least one dye and at least one polyhydric alcohol at a temperature above a glass transition temperature of the polyester film to obtain a dyed film;

cleaning the dyed film using a boiling solvent, followed by mechanically scrubbing the cleaned film to remove undissolved particles from the film; and passing the cleaned and scrubbed film through a tenter and oven to produce a colored polyester film having controlled shrinkage.

19. The colored polyester film according to claim 18, having a UV transmittance below 2%.

20. A laminate for use on curved automobile glass comprising a colored polyester film according to claim 18.

21. A decorative film comprising a colored polyester film according to claim 18.

22. A film for application to windows or to steel, comprising a colored polyester film according to claim 18.

* * * * *